US006651334B2

(12) United States Patent
Chikuma et al.

(10) Patent No.: US 6,651,334 B2
(45) Date of Patent: Nov. 25, 2003

(54) TANK OF HEAT EXCHANGER AND METHOD OF PRODUCING SAME

(75) Inventors: Hiroshi Chikuma, Kanagawa (JP); Yoshinobu Okuno, Barcelona (ES); Takahiro Nakakomi, Kanagawa (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 10/176,408

(22) Filed: Jun. 21, 2002

(65) Prior Publication Data

US 2003/0010484 A1 Jan. 16, 2003

(30) Foreign Application Priority Data

Jun. 26, 2001 (JP) ..... 2001-192899

(51) Int. Cl.[7] ..... F28F 9/02
(52) U.S. Cl. ..... 29/890.052; 165/174
(58) Field of Search ..... 165/173–176, 165/153; 29/890.052

(56) References Cited

U.S. PATENT DOCUMENTS 5,782,295 A * 7/1998 Kato et al. ..... 165/174
6,062,303 A 5/2000 Ahn et al.
6,289,980 B1 * 9/2001 Insalaco et al. ..... 165/174

FOREIGN PATENT DOCUMENTS

| | | | | |
|---|---|---|---|---|
| EP | 0 450 619 A1 | | 10/1991 | |
| EP | 0 479 775 A2 | | 4/1992 | |
| EP | 1 046 876 A2 | | 10/2000 | |
| FR | 2 766 265 A1 | | 1/1999 | |
| JP | 04353397 A | * | 12/1992 | ..... 165/173 |
| JP | 7-40864 | | 9/1995 | |
| JP | 11-108582 A | | 4/1999 | |

* cited by examiner

*Primary Examiner*—Leonard R. Leo
(74) *Attorney, Agent, or Firm*—Foley & Lardner

(57) ABSTRACT

A tank of a condenser for an air conditioning system of an automotive vehicle. The tank comprises a cylindrical hollow tank main body which is formed with an arcuate cutout formed through a wall of the tank main body. A partition plate includes generally semicircular large and small diameter sections which are integral with each other to be formed into a generally disc-shape. Two projections are radially outwardly protrude respectively from opposite end portions of the generally semicircular large diameter section. During production of the tank, the partition plate is temporarily fixed to the tank main body by riveting the two projections in a state in which the partition plate has been inserted through the cutout of the tank main body, and the partition plate is brazed to the tank main body in a state in which the plate has been temporarily fixed.

8 Claims, 5 Drawing Sheets

TANK OF HEAT EXCHANGER AND METHOD OF PRODUCING SAME

BACKGROUND OF THE INVENTION

1. Field of the Invention

This invention relates to improvements in a tank of a heat exchanger and a method of producing the tank, and more particularly to the tank provided with partition plates for dividing the inside of the tank.

2. Description of the Prior Art

Hitherto it has been well known that a tank main body of a heat exchanger is provided with partition plates which divide the inside of the tank main body, as disclosed in Japanese Utility Model Publication 7-40864. The essential part of this heat exchanger is shown in detail in FIG. 7, in which the tank main body 1 of the hollow cylindrical shape is formed with an arcuate cutout 1*a* through which the partition plate 2 is inserted and disposed inside the tank main body 1. The partition plate 2 includes a generally semicircular large diameter section 2*a* and a generally semicircular small diameter section 2*b* which are integral with each other to be formed into the disc-shape. The large diameter section 2*a* has a periphery corresponding to the outer peripheral shape of the tank main body (or of the cutout), while the small diameter section 2*b* has a periphery corresponding to the inner peripheral shape of the tank main body.

The tank main body 1 is further formed with a plurality of tube openings 1*b* into which the end sections of tubes 3 are inserted and fitted. The tubes 3 form part of a core of the heat exchanger. The tube openings 1*b* are located on opposite side of the cutout 1*a* in the tank main body 1. A corrugated fin 4 is fixedly disposed between the adjacent tubes 3.

The partition plate 2 will be fixed to the tank main body 1 as follows: Impacts are simultaneously applied from the directions of arrows A and B onto upper and lower edge portions around the cutout 1*a* in a state where the partition plate 2 has been inserted through the cutout 1*a* into the tank main body 1, as shown in FIG. 8A. As a result, the upper and lower edge portions around the cutout 1*a* make their plastic deformation to form plastic deformation portions 1*c*, 1*c* which temporarily fix the partition plate 2 in position in the tank main body 1, as shown in FIG. 8B.

However, drawbacks have been encountered in such a conventional producing method of the tank of the heat exchanger, in which a relatively high precision working process is required to temporarily fix the partition plate through the cutout 1*a* into the tank main body 1*a*. In other words, in the conventional producing method, it is required to apply the impacts in predetermined angles to the partition plates 2. More specifically, it is required to precisely apply the impacts from the predetermined angles under a condition in which the cutout 1*a* of the tank main body 1 is positioned at a high precision.

SUMMARY OF THE INVENTION

It is, therefore, an object of the present invention to provide an improved tank of a heat exchanger and an improved method of producing the tank, which can overcome drawbacks encountered in conventional tanks for heat exchangers and methods for producing the tanks.

Another object of the present invention is to provide an improved tank of a heat exchanger and an improved method of producing the tank, in which a partition plate for dividing the inside of a tank main body is easily and securely temporarily fixed through a cutout to the tank main body of the tank.

A further object of the present invention is to provide an improved tank of a heat exchanger and an improved method of producing the tank, in which a partition plate for dividing the inside of a tank main body is temporarily securely fixed prior to fixation by brazing, without requiring a high precise working process.

An aspect of the present invention resides in a tank of a heat exchanger. The tank comprises a cylindrical hollow tank main body formed of aluminum and having an arcuate cutout formed through a wall of the tank main body. A partition plate is formed of aluminum and includes a generally semicircular small diameter section, and a generally semicircular small diameter section which is integral with the generally large diameter section to be formed into a generally disc-shape. The generally large diameter section has an arcuate outer periphery which corresponds to a shape of an outer periphery of the tank main body. The generally small diameter section has an arcuate outer periphery which corresponds to a shape of an inner periphery of the tank main body. First and second projections are radially outwardly protrude respectively from opposite end portions of the generally semicircular large diameter section. The opposite end portions correspond to the respective opposite end parts of the arcuate periphery of the generally semicircular large diameter section. In the tank, the partition plate is temporarily fixed to the tank main body by riveting the first and second projections in a state in which the partition plate has been inserted through the cutout of the tank main body so that a major part of the partition plate is located inside the tank main body, and the partition plate is brazed to the tank main body in a state in which the plate has been temporarily fixed.

With the above tank, the partition plate is temporarily fixed through the cutout to the tank main body by riveting the projections of the partition plate from the opposite sides of the tank man body in a condition in which the partition plate is inserted through the cutout into the tank main body, thereby easily and securely accomplishing the temporary fixation of the partition plate.

Another aspect of the present invention resides in a method for producing a tank of a heat exchanger. The method comprises (a) preparing a cylindrical hollow tank main body formed of aluminum and having an arcuate cutout formed through a wall of the tank main body; (b) preparing a partition plate formed of aluminum and including a generally semicircular small diameter section, and a generally semicircular small diameter section which is integral with the generally large diameter section to be formed into a generally disc-shape, the generally large diameter section having an arcuate outer periphery which corresponds to a shape of an outer periphery of the tank main body, the generally small diameter section having an arcuate outer periphery which corresponds to a shape of an inner periphery of the tank main body, the partition plate having first and second projections which radially outwardly protrude respectively from opposite end portions of the generally semicircular large diameter section, the opposite end portions corresponding to the respective opposite end parts of the arcuate periphery of the generally semicircular large diameter section; (c) inserting the partition plate through the cutout of the tank main body so that a major part of the partition plate is located inside the tank main body; (d) riveting first and second projections by first and second riveting jigs which are movably disposed at opposite sides of the tank main body so as to temporarily fix the partition plate to the tank main body; and (e) brazing the partition plate to the tank main body in a state in which the partition plate has been temporarily fixed to the tank main body.

With the above production method, the projections of the partition plate are riveted from the opposite sides of the tank main body by a pair of the riveting jigs after the partition plate has been inserted through the cutout into the tank main body so as to temporarily fix the partition plate through the cutout into the tank main body, thus easily and securely achieving the temporary fixation of the partition plate.

DETAILED DESCRIPTION OF THE INVENTION

Figure 1:
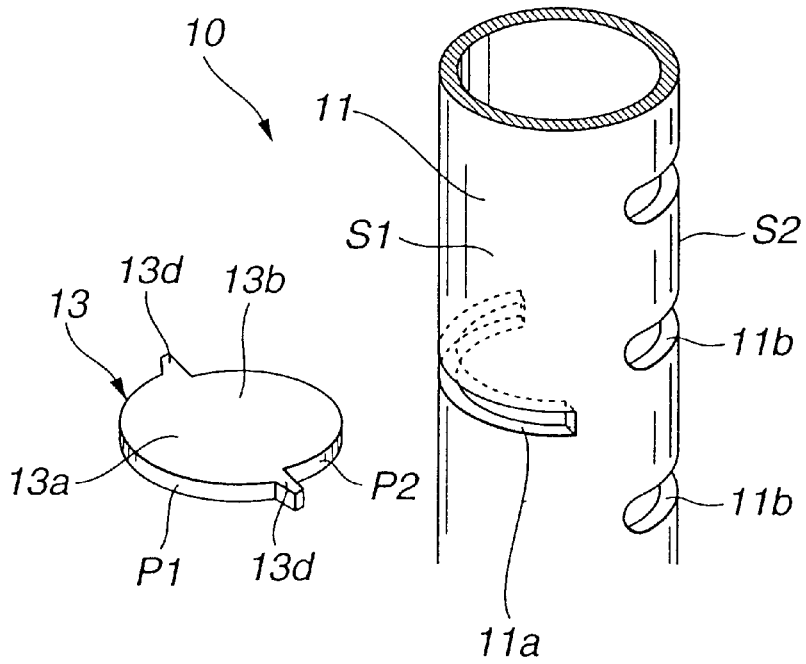
FIG. 1 is a fragmentary exploded perspective view of an embodiment of a tank for a heat exchanger, according to the present invention.
Figures 2A, 2B:
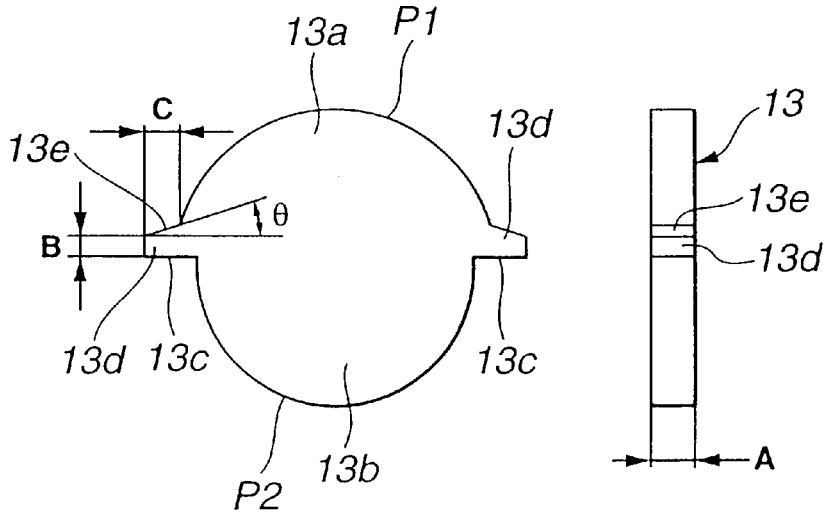
FIG. 2A is a plan view of a partition plate of the tank of FIG. 1.
FIG. 2B is a side view of the partition plate of FIG. 2A.

Referring now to FIGS. 1 and 2A and 2B, an embodiment of a tank of a heat exchanger, according to the present invention is illustrated by the reference numeral 10. The tank 10 comprises a cylindrical hollow tank main body 11 which is formed with cutouts 11*a* (only one cutout is shown). Each cutout 11*a* is formed arcuate and extends along the periphery of the tank main body 11 or parallel with an imaginary plane (not shown) perpendicular to the axis of the tank main body 11. Each cutout 11*a* is formed through a cylindrical wall (not identified) of the tank main body 11, i.e., passes through from the outer peripheral surface to the inner peripheral surface of the tank main body 11. The cutouts 11*a* are located in an imaginary axially extending semicylindrical section S1 of the tank main body 11. In other words, at least a major part of each cutout 11*a* is located in the semicylindrical section S1.

The tank main body 11 is further formed with a plurality of tube openings 11*b* which are located in the other imaginary axially extending semicylindrical section S2 which is opposite to the semicylindrical section S1. In other words, at least a major part of each tube opening 11*b* is located at the semicylindrical section S2. An end section of a tube 23 is inserted through the tube opening 11*b* into the tank main body 11 as discussed in detail after. The tank main body 11 is formed of a clad material of aluminum and a solder layer, in which the solder layer is formed at the outer peripheral side of the tank main body 11.

A partition plate 13 is to be inserted into the tank main body 11 through the cutout 11*a* so that an arcuate peripheral part of the partition plate 13 is disposed in the cutout 11*a* while a major part of the partition plate is disposed inside the tank main body 11. The partition plate 13 serves to divide the inside of the tank main body 11 into two parts which are located on the opposite sides of the partition plate 13. The partition plate 13 is formed of a clad material of aluminum and solder layers, in which aluminum serves as a core material so that the solder layers are formed on the opposite sides of the core material of aluminum.

As shown in FIG. 2, the partition plate 13 is disc-shaped and includes a large diameter (radius) semicircular section 13*a* and a small diameter (radius) semicircular section 13*b* which are the same in thickness and integral with each other to be formed into the disc-shape. The large diameter semicircular section 13*a* is larger in radius than the small diameter semicircular section 13*b*. The generally semicylindrical or arcuate peripheral surface P1 of the large diameter semicircular section 13*a* is coaxial with that P2 of the small diameter semicircular section 13*b*. The shape of the peripheral surface P1 of the large diameter semicircular section 13*a* corresponds to the outer peripheral shape of the tank main body 11, while the shape of the peripheral surface P2 of the small diameter semicircular section 13*b* corresponds to the inner peripheral shape of the tank main body 11.

Two radially extending flat step portions or faces 13*c* are formed respectively near positions at which the peripheral surface P1 of the large diameter semicircular section 13*a* approaches the peripheral surface P2 of the small diameter semicircular section 13*b*. The surface of each flat step portion 13*c* radially outwardly extends. Two projections 13*d* are formed at the opposite end portions of the large diameter semicircular section 13*a* and radially outwardly protrude. More specifically, the projections 13*d* is the same in thickness as the large diameter semicircular section 13*a* and have generally the shape of a frustum of pyramid. Each projection 13*d* has a flat surface flush with the flat step portion 13*c* and therefore radially outwardly extends. Each projection 13*d* has a flat tip end face (not identified) which is generally perpendicular to the flat step portion 13*c*. Additionally, the projection 13*d* has an inclined face 13*e* which inclines or angular relative to the flat step portion 13*c* and contiguous with the peripheral surface P1 of the large diameter semicircular section 13*a* and with the flat tip end face of the projection 13*d*. In this connection, the flat step portion 13*c* is contiguous with the peripheral surface P2 of the small diameter semicircular section 13*b* and with the flat tip end face of the projection 13*d*.

In this embodiment, the thickness A of the partition plate 13 is, for example, within a range of from 1.0 to 2.5 mm so as to be fitted in the cutout 11*a*. The width B of the flat tip end face of the projection 13*d* is, for example, within a range of from 0.5 to 1.5 mm. The radial or protruding length C of the projection 13*d* from the peripheral surface P1 is, for example, within a range of from 1 to 2 mm. The inclined face 13*e* of the projection 13*d* has an inclination angle θ of not larger than 45° relative to an imaginary flat plane which radially extends and is parallel with the flat step portion 13*c*.

Manner of fixing the partition plate 13 through the cutout 11*a* to the tank main body 11 will be discussed with reference to FIGS. 3A to 3C.

Figure 3A:
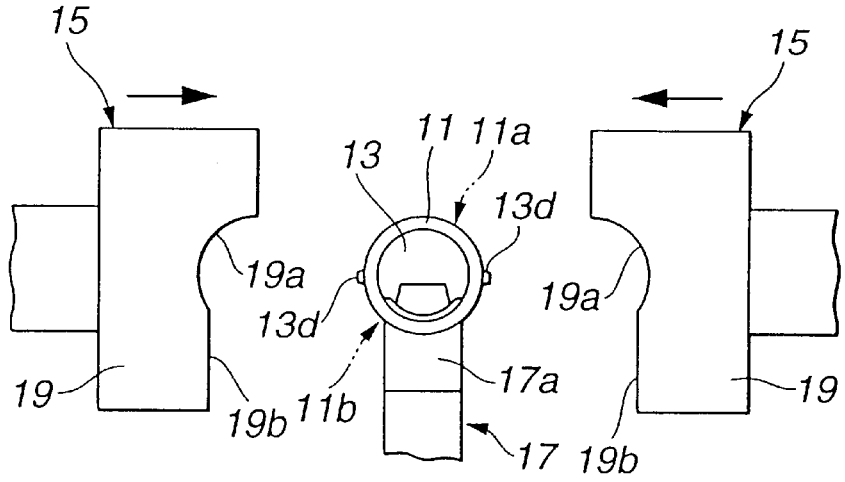
FIG. 3A is a schematic plan view showing a first step in a process of temporarily fixing the partition plate under riveting.

First, the tank main body 11 is located between a pair of riveting jigs 15 which are separate from each other as shown in FIG. 3A. The riveting jigs 15 are movable in directions indicated by arrows so as to approach each other. Each riveting jig 15 includes a pressing member 19 which is formed with a generally semicylindrical pressing surface 19*a*. The semicylindrical pressing surfaces 19*a* of the pressing members 19 face to each other and will form a generally cylindrical pressing surface having the generally same diameter as that of the tank main body 11 when the pressing members 19 are brought into contact with each other. As shown, a lower section of the pressing member 19 is cutout to form a run-off surface 19*b*.

As shown in FIG. 3A, the tank main body 11 is located such that the tube openings 11*b* thereof are positioned below. Then, a positioning nail 17*a* of a supporting device 17 is inserted through the tube opening 11*b* into the tank main body 11 from the lower side, so that the cutout 11*a* of the tank main body 11 is accurately positioned to open to the upper side. At this state, the partition plate 13 is inserted through the cutout 11*a* into the tank main body 11, in which the peripheral surface P2 of the small diameter semicircular section 13*b* is brought into contact with the inner peripheral surface of the tank main body 11 while the peripheral surface P1 of the large diameter semicircular section 13*a* is brought into flush with the outer peripheral surface of the tank main body 11. At this time, the flat step portions 13*c* of the partition plate 13 are respectively brought into contact with the flat end faces (no numerals) defining the opposite ends of the cutout 11*a*. Consequently, the projections 13*d* radially outwardly protrude in the opposite directions from the outer peripheral surface of the tank main body 11. It will be understood that the partition plate 13 may be previously inserted through the cutout 11*a* into the tank main body 11 before the positioning of the cutout 11*a* of the tank main body 11 is accomplished.

Figure 3B:
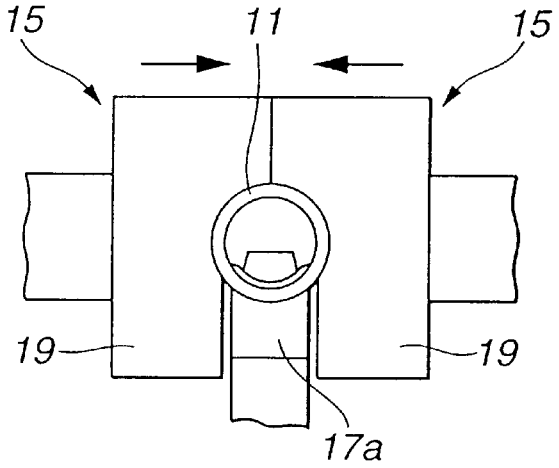
FIG. 3B is a schematic plan view showing a second step in the process of FIG. 3A.

Subsequently, as shown in FIG. 3B, the riveting jigs 15 are moved in the direction to approach each other or in the direction indicated by arrows so that the pressing members 19 are brought into contact with each other. At this time, the projections 13*d* protruded in the opposite directions from the outer peripheral surface of the tank main body 11 are pressed and riveted by the opposite pressing surfaces 19*a* so as to accomplish a temporary fixing of the partition plate 13 in the cutout 11*a* of the tank main body 11. It will be understood that the pressing members 19 are prevented from contacting with the positioning nail 17*a* of the supporting device 17 even when the pressing members 19 are brought into contact with each other, under the effect of a run-off space (no numeral) defined between the run-off surfaces 19*b* of the pressing members 19.

Figure 3C:
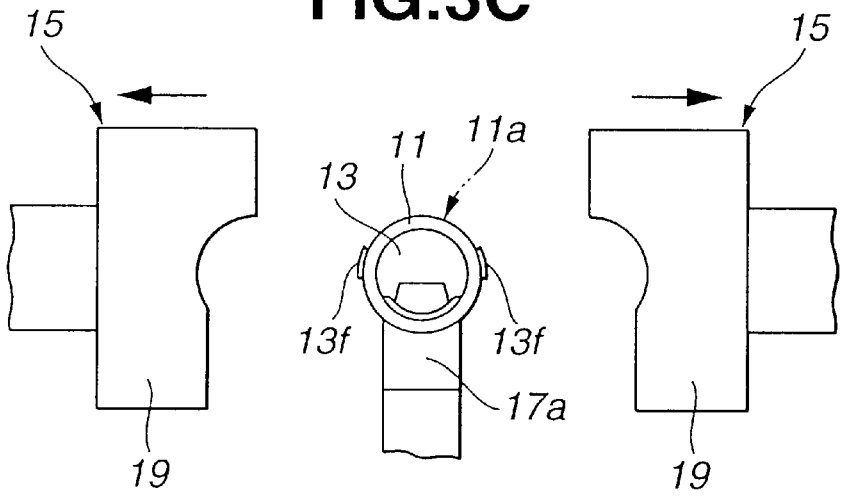
FIG. 3C is a schematic plan view showing a third step in the process of FIG. 3A.

Thereafter, as shown in FIG. 3C, the riveting jigs 15 are moved in the directions as indicated by arrows so as to separate from each other. Then, the tank main body 11 in a state where the partition plate 13 has been temporarily fixed into the cutout 11*a* is taken out from the riveting jigs 15.

Figure 4A:
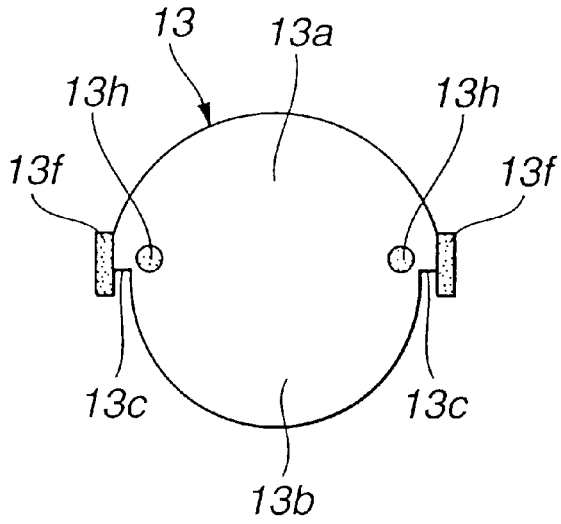
FIG. 4A is a schematic plan view of the partition plate which is in a state obtained after the riveting has been completed.
Figure 4B:
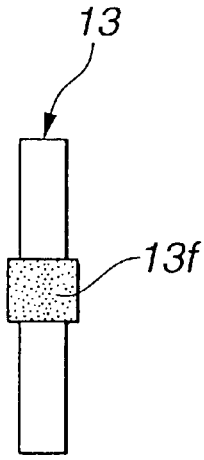
FIG. 4B is a schematic side view of the partition plate of FIG. 4A.
Figure 5:
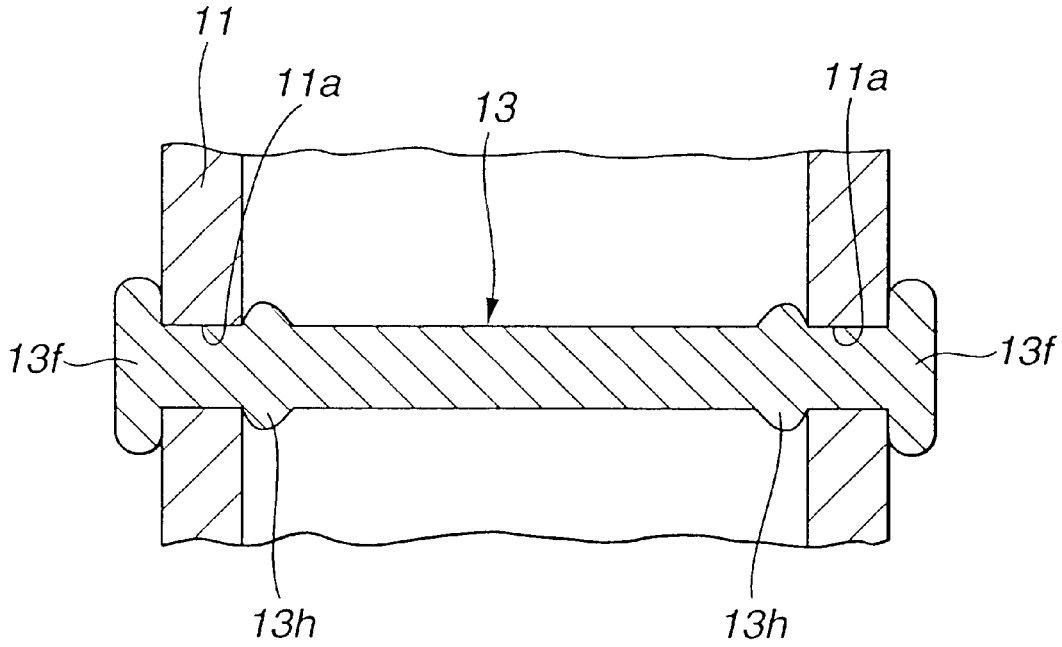
FIG. 5 is a fragmentary schematic sectional view showing the state of deformation of the partition plate relative to the cutout after the riveting has been completed.

FIGS. 4A and 4B schematically show a deformed state of the partition plate 13 after completion of the riveting treatment with the riveting jigs 15, in which the projections 13*d* protruding from the opposite side of the large diameter semicircular section 13*a* are riveted and extend radially along the peripheral surface of the tank main body 11 so as to form a plastic deformation portions 13*f*. With the plastic deformation of the projections 13*d*, the thickness of portions of the partition plate 13 located on a line connecting the opposite projections 13*d* increases under the plastic flow of the material of the partition plate 13 thereby forming thick portions 13*h*. In other words, after the riveting treatment, the partition plate 13 takes a state shown in FIG. 5 which is a fragmentary vertical section of the tank 10 taken along the line connecting the opposite projections 13*d*. In the state of FIG. 5, the wall of the tank main body 11 around the opposite ends of the cutout 11*a* are securely put between the plastic formation portion 13*f* and the thick portion 13*h*, thereby securely accomplishing the temporary fixation of the partition plate 13 into the cutout 11*a*. As a result, the tank 10 is formed.

Thereafter, flux is coated on the thus formed tank 10 in a state in which the tank 10 is assembled with the other section of a heat exchanger. Then, the thus assembled heat exchanger is subjected to heat treatment within a brazing furnace. As a result, the partition plates 13 are brazed to the tank main body 11 at portions around the cutout 11*a*, thus producing a heat exchanger as shown in FIG. 6.

Figure 6:
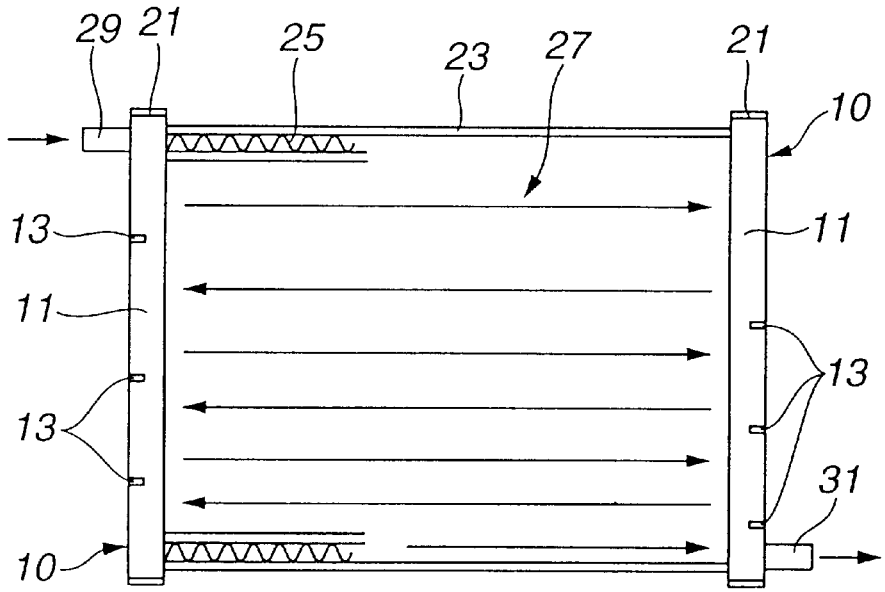
FIG. 6 is a plan view of a condenser for an air conditioning system, using the tank of FIG. 1.
Figure 7:
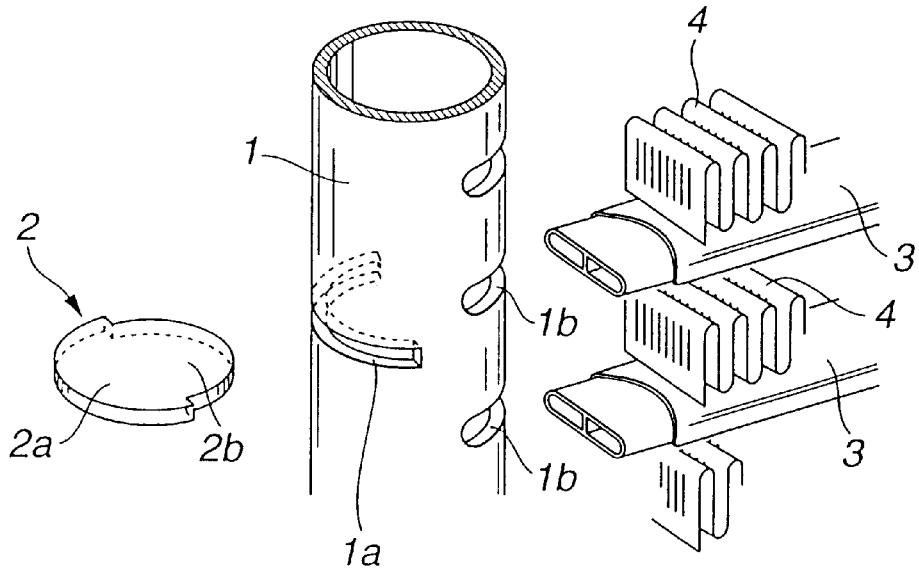
FIG.7 (PRIOR ART)
FIG. 7 is a fragmentary exploded perspective view illustrating a conventional tank for a heat exchanger.
Figure 8A:
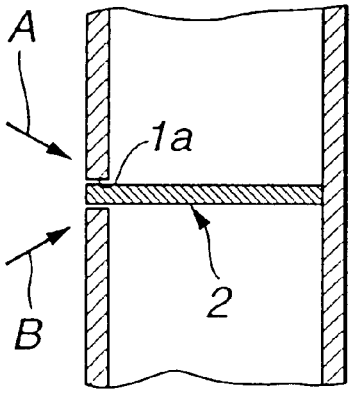
FIG.8A (PRIOR ART)
FIG. 8A is a fragmentary sectional explanatory view for a conventional method of temporarily fixing a partition plate through a cutout to a tank main body in a tank of FIG. 7, showing a state before application of impacts.
Figure 8B:
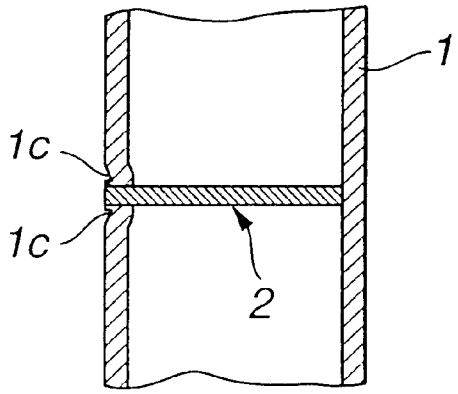
FIG.8B (PRIOR ART)
FIG. 8B is a fragmentary sectional explanatory view similar to FIG. 8A, but showing another state after application of the impacts.

The heat exchanger shown in FIG. 6 serves as a condenser of an air conditioning system for an automotive vehicle. The heat exchanger includes a pair of the tanks 10 which are parallelly located spaced apart from each other. The opposite ends of each of the tanks 10 is sealingly closed with an end plate 21. A core 27 is disposed between the tanks 10 and includes a plurality of the tubes 23 which parallelly extend from one (left-side) tank 10 to the other (right-side) tank 10 in such a manner that a space is defined between the adjacent tubes 23. It will be understood that one (left-side) end section of each tube 23 is sealingly inserted through the tube opening 11*b* into the left-side tank main body 11, while the other (right-side) end section of the tube 23 is sealingly inserted through the tube opening 11*b* into the right-side tank main body 11. A corrugated fin 25 is fixedly disposed in the space between the adjacent tubes 23. The left-side tank 10 is provided with an inlet pipe 29 through which coolant is supplied into the heat exchanger, while the right-side tank 10 is provided with an outlet pipe 31 through which the coolant is discharged from the heat exchanger.

The left-side tank 10 is provided with three partition plates 13 in the respective positions as shown in FIG. 6, while the right-side tank 10 is provided with three partition plates 13 at the respective positions different from those in the left-side tank 10 as shown in FIG. 6. In this heat exchanger as the condenser, the coolant flowing through the inlet pipe 29 into the heat exchanger flows in a zigzag direction through the core 27 as indicated by arrows so as to be cooled, and then flows out through the outlet pipe 31.

As appreciated from the above, according to the tank of the heat exchanger, the projections 13*d* are riveted respectively from the opposite sides of the tank main body 11 so that the partition plate 13 is temporarily fixed to the cutout 11*a* and therefore easily and securely temporarily fixed to the tank main body 11. Additionally, in the above method of producing the heat exchanger, the projections 13*d* of the partition plate 13 are riveted from the opposite sides of the partition plate 13 by a pair of the riveting jigs 15 which are disposed at the opposite sides of the partition plate 13, after the partition plate 13 is inserted into the cutout 11*a*. Thus, the partition plate 13 is temporarily fixed to the cutout 11*a* of the tank main body 11, thereby easily and securely accomplishing the temporary fixation of the partition plate to the tank main body 11.

Further, the width B of the flat tip end face of the projection 13*d* is relatively small, for example, as 0.5 to 1.5 mm. Accordingly, the projection 13*d* can be riveted under a relatively small force without occurrence of buckling of the partition plate 13. Additionally, the protruding length C of the projection 13*d* is, for example, 1 to 2 mm, and therefore a sufficient force for temporarily fixing the partition plate 13 can be secured. Besides, since an inclination angle θ of the inclined face 13*e* of the projection 13*d* is not larger than 45°, a large riveting force is not required when the projections 13*d* are riveted upon insertion of the partition plate 13 through the cutout 11*a*, so that the durability of a working die (such as a punch die) can be improved while preventing the projection 13*d* from deformation during punching of the partition plate 13 having the projections 13*d*.

While the tank 10 of the above embodiment has been shown and described as being applied to the condenser, it will be understood that the principle of the present invention is not limited to be applied to the tank of the condenser and therefore may be extensively applied to heat exchangers in which the inside of a tank is required to be divided into a plurality of spaces.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

This application claims priority to Japanese Patent Application 2001-192899 filed Jun. 26, 2001.

What is claimed is:

1. A tank of a heat exchanger, comprising:

a cylindrical hollow tank main body formed of aluminum and having an arcuate cutout formed through a wall of the tank main body;

a partition plate formed of aluminum and including a generally semicircular large diameter section, and a generally semicircular small diameter section which is integral with the generally large diameter section to be formed into a generally disc-shape, the generally large diameter section having an arcuate outer periphery which corresponds to a shape of an outer periphery of the tank main body, the generally small diameter section having an arcuate outer periphery which corresponds to a shape of an inner periphery of the tank main body; and first and second projections which radially outwardly protrude respectively from opposite end portions of the generally semicircular large diameter section;

wherein the partition plate is temporarily fixed to the tank main body by riveting the first and second projections in a state in which the partition plate has been inserted through the cutout of the tank main body so that a major part of the partition plate is located inside the tank main body, and the partition plate is brazed to the tank main body in a state in which the partition plate has been temporarily fixed.

2. A tank as claimed in claim 1, wherein each of said first and second projections has an inclined face which is inclined relative to an imaginary radially extending flat plane in said partition plate.

3. A tank as claimed in claim 1, wherein each of said first and second projections has a flat tip end face which is perpendicular to an imaginary radially extending flat plane in said partition plate.

4. A tank is claimed in claim 1, wherein the opposite end portions correspond to respective opposite end parts of the arcuate cutout of the wall.

5. A method for producing a tank of a heat exchanger, comprising the following steps:

preparing a cylindrical hollow tank main body formed of aluminum and having an arcuate cutout formed through a wall of the tank main body;

preparing a partition plate formed of aluminum and including a generally semicircular large diameter section, and a generally semicircular small diameter section which is integral with the generally large diameter section to be formed into a generally disc-shape, the generally large diameter section having an arcuate outer periphery which corresponds to a shape of an outer periphery of the tank main body, the generally small diameter section having an arcuate outer periphery which corresponds to a shape of an inner periphery of the tank main body, the partition plate having first and second projections which radially outwardly protrude respectively from opposite end portions of the generally semicircular large diameter section;

inserting the partition plate through the cutout of the tank main body so that a major part of the partition plate is located inside the tank main body;

riveting first and second projections by first and second riveting jigs which are movably disposed at opposite sides of the tank main body so as to temporarily fix the partition plate to the tank main body; and brazing the partition plate to the tank main body in a state in which the partition plate has been temporarily fixed to the tank main body.

6. A method as claimed in claim 5, wherein each of the first and second jigs has a generally semicylindrical pressing surface which corresponds to a shape of a cylindrical surface of the tank main body, wherein the riveting step includes crushing each of the first and second projections with the generally semicylindrical pressing surface.

7. A method as claimed in claim 6, wherein the riveting step includes moving the first and second riveting jigs radially inwardly relative to the cylindrical hollow tank main body.

8. A method is claimed in claim 5, wherein the opposite end portions correspond to respective opposite end parts of the arcuate cutout of the wall.

* * * * *